United States Patent [19]

Agostini

[11] Patent Number: 4,712,924

[45] Date of Patent: Dec. 15, 1987

[54] WATCH FOR DISPLAYING A LINE ON THE DIAL

[75] Inventor: Fabrizio Agostini, Florence, Italy

[73] Assignee: Trast Enterprise S.r.l., Florence, Italy

[21] Appl. No.: 864,992

[22] Filed: May 20, 1986

[30] Foreign Application Priority Data

May 20, 1985 [IT] Italy ..... 67462 A/85
May 5, 1986 [IT] Italy ..... 53359/86[U]

[51] Int. Cl.[4] ..... G04B 19/04

[52] U.S. Cl. ..... 368/76; 368/80; 368/223

[58] Field of Search ..... 368/76, 77, 80, 223, 368/228, 232–234

[56] References Cited

U.S. PATENT DOCUMENTS 3,712,046 1/1973 Dill ..... 368/77
3,952,500 4/1976 Tomura ..... 368/238
4,473,304 9/1984 Ketner ..... 368/77
4,601,585 7/1986 Farley ..... 368/80

FOREIGN PATENT DOCUMENTS 929179 5/1946 France ..... 368/238
2300362 9/1976 France ..... 368/233
982054 2/1965 United Kingdom ..... 368/238

*Primary Examiner*—Vit W. Miska
*Attorney, Agent, or Firm*—Sughrue, Mion, Zinn, Macpeak & Seas

[57] ABSTRACT

In a clock comprising a clock casing (2), a dial, time indicator means (7a) associated with the dial, and means for controlling the indicator means, the latter are arranged to display a line (14a) on the dial, the ends of which point towards two separate zones on the periphery of the dial corresponding to the time to be indicated. According to a particular embodiment, the indicator means are also arranged to display two further lines (19, 20) joining the ends of the said lines (14a) to the center of the dial (3).

12 Claims, 8 Drawing Figures

WATCH FOR DISPLAYING A LINE ON THE DIAL

Figure 1:
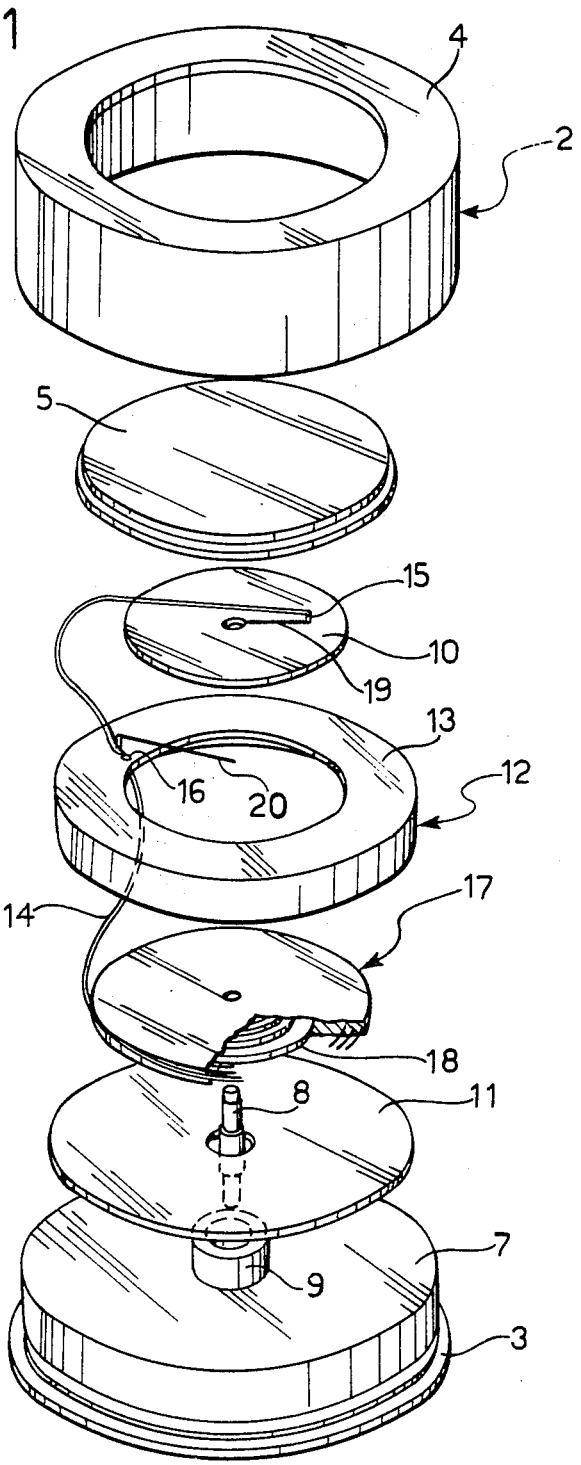

The present invention relates to clocks.

Any conventional clock comprises a clock casing, a dial, time indicator means associated with the dial, and means for controlling the indicator means.

The object of the invention is to provide a clock with a simple and reliable structure, in which the time indicator means are arranged to provide a clear indication while at the same time being aesthetically pleasing.

In order to achieve this object, the invention provides a clock of the type described above, the main characteristic of which lies in the fact that the indicator means are arranged to display a line on the dial, the ends of which point towards two separate zones of the periphery of the dial corresponding to the time to be indicated.

In a first embodiment, the indicator means comprise a central disc and an outer annular ring concentric with the central disc, the central disc and the outer annular ring being rotated by the control means to indicate the hours and the minutes respectively, and a variable-length element interconnecting a zone of the outer annular ring and a zone of the central disc spaced from the centre of the dial.

In this embodiment, the use is envisaged of a wire fixed at one end to the central disc in correspondence with the said zone and passing through an aperture formed in the outer annular ring in correspondence with the outer zone, the clock further including a wire-winding spool which is resiliently biassed towards a fully-wound position, and is arranged to maintain the portion of wire between the two zones under tension, this portion of wire constituting the variable-length element.

In a variant of this first embodiment, the variable length element is a telescopic rod the ends of which are articulated to the central disc and to the outer annular ring respectively.

In a second embodiment, the time indicator line is displayed by means of a liquid crystal system. The line displayed by liquid crystals may be either a straight line or a curved line having both ends adjacent the periphery of the dial or having at least one of these ends spaced from the periphery. When the time indicator line has its ends adjacent the periphery of the dial so as to divide the surface of the dial into two distinct areas, the liquid crystal system may be arranged to create a contrast between these two areas so as to display a time indicator line as a result.

In a third embodiment of the invention, the indicator means are also arranged to display two further lines joining the ends of the time indicator line to the centre of the dial. In this embodiment, therefore, the time is indicated by a triangle whose shape changes with time, in which two sides correspond to the hands of a conventional clock and the third side joins the outer ends of the first two sides.

For this embodiment a solution is also envisaged which corresponds to that described above and which uses a wire and a wire-winding spool within the clock.

Naturally , in this case also, it is possible to provide liquid crystal display means.

Finally, in order to display the triangle described above, a solution may be foreseen in which the time indicator means comprise a pair of hands rotated about the centre of the dial to indicate the hours and the minutes respectively, and a and which connects the outer ends of the two hands and is constituted by at least two elements slidable relative to each other.

Figure 2:
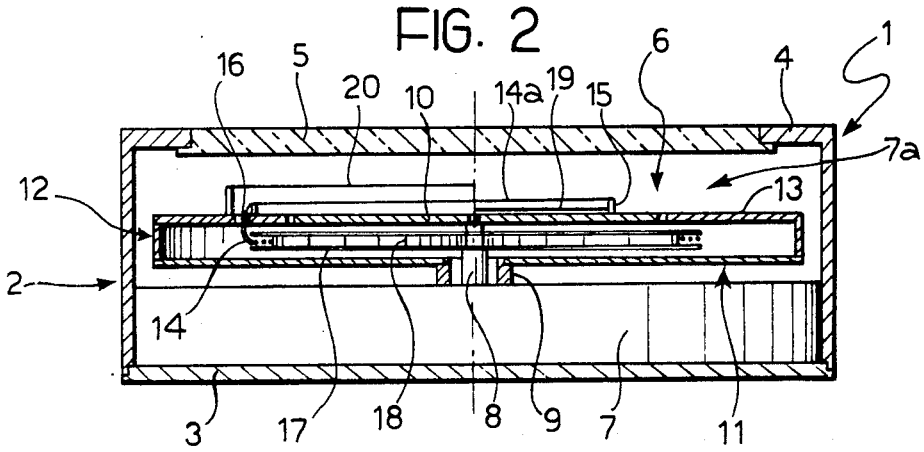
Figure 3:
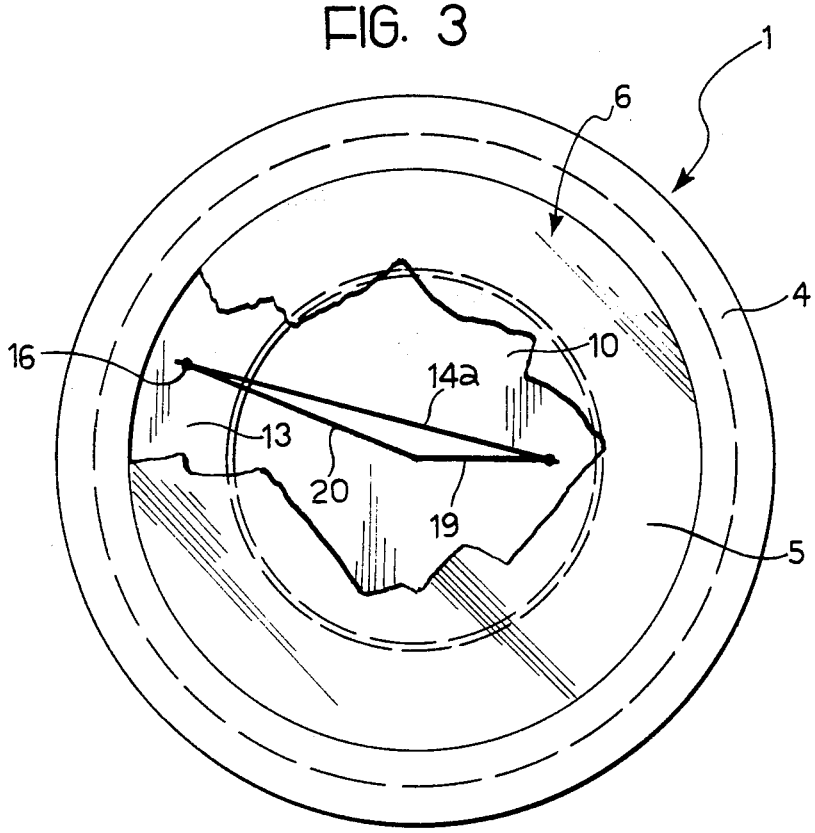
Figure 4:
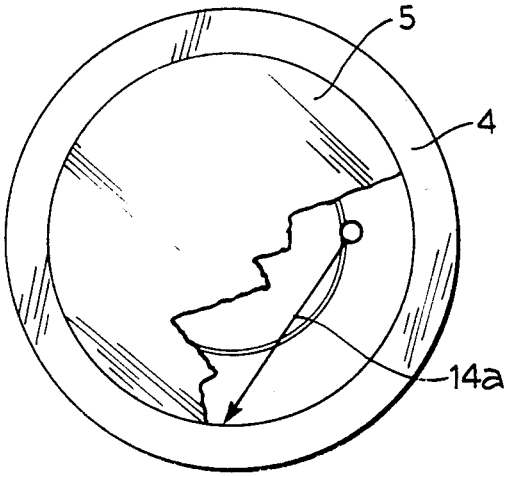
Figure 5:
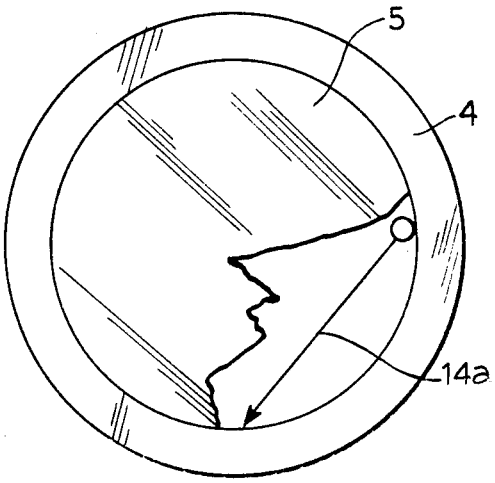
Figure 6:
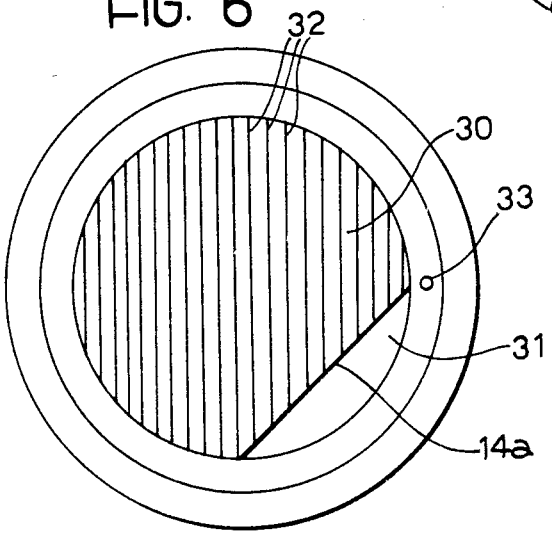
Figure 7:
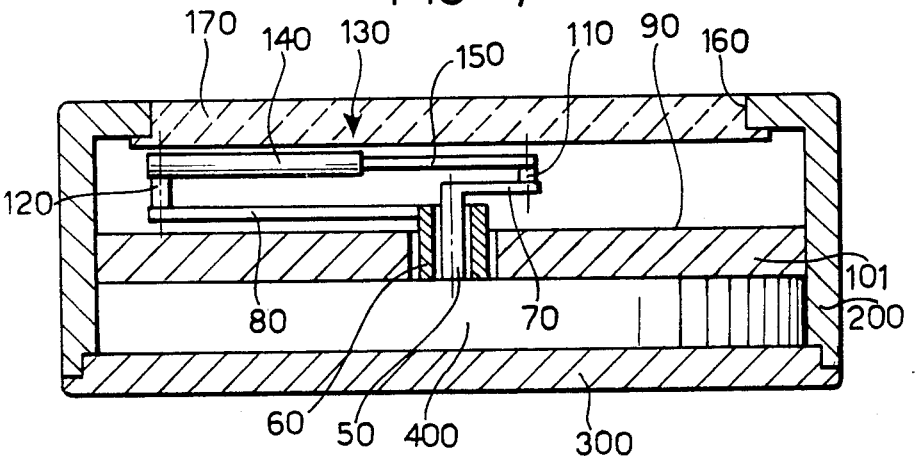
Figure 8:
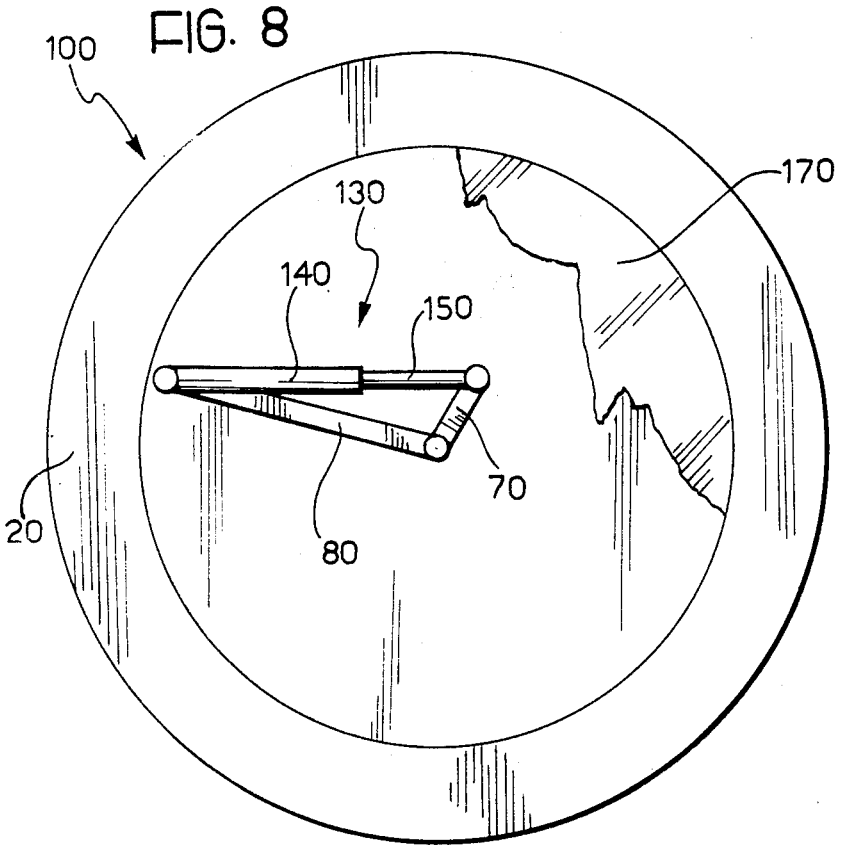

Further characteristics and advantages of the invention will become apparent from the description which follows with reference to the appended drawings, provided purely by way of non-limiting example, in which:

FIG. 1 is an exploded perspective view of one embodiment of the clock according to the invention, FIG. 2 is a sectional view of the clock of FIG. 1 in a plane containing the central axis of the clock, FIG. 3 is a front view of the clock of FIGS. 1 and 2, FIGS. 4 to 6 illustrate three further embodiments of the clock according to the invention, and FIGS. 7 and 8 are a sectional view and a front view of a further embodiment of the invention.

With reference to FIGS. 1 and 3, a clock is generally indicated 1 and includes a clock casing 2 having a base 3. The front face of the casing 2 has a peripheral ring 4 which supports a glass 5 facing the dial 6 of the clock.

Within the casing 2 is a clock mechanism 7 for controlling the time indicator means, generally indicated *7a*.

From the clock mechanism 7 project a central shaft 8 which will rotate at a rate of one revolution every twelve hours and a tubular shaft 9 intended to rotate at a rate of one revolution per hour. The central shaft 8 supports a central disc 10, while the annular shaft 9 supports, by means of a disc 11, an annulus 12 including an outer annular ring 13 concentric with the central disc 10 and coplanar therewith.

A wire of any suitable material, indicated 14, has one end fixed to a pin 15 rotatably mounted on one zone of the central disc 10 spaced from the central axis of the clock and passes through an aperture 16 formed in the outer annular ring 13. The remaining part of the wire 14 is disposed within the chamber defined between the disc 11 and the annulus 12 and is wound on a winding spool 17. The winding spool 17 is freely rotatable on the shaft 8 and is biassed resiliently towards a fully-wound position of the wire. Thus, during movement of the central disc 10 and the outer annular ring 13, the portion of the wire 14 between the element 15 carried by the central disc 10 and the aperture 16 in the outer annular ring 13 is maintained constantly under tension. The resilient means which bias the spool 17 towards the fully-wound position of the wire are constituted by a spiral spring 18 located within the spool 17, which is hollow, and has one end connected to the shaft 8 and the other end connected to the wall of the spool 17. Naturally, the wire 14 could alternatively be fixed to the ring 13 and the aperture 16 could be formed in the disc 10.

In the embodiment illustrated, the central disc 10 which, as described above, is intended to rotate at a rate of one revolution every twelve hours, carries a reference line 19 extending radially and joining the centre of the disc 10 to the zone in which the element 15 is disposed. Similarly, the outer annular ring 13 supports a reference needle 20 extending radially between the axis of the clock and the zone in which the aperture 16 of the outer annular ring 13 is formed.

It is clear from FIG. 3 that, as a result of the aforesaid structure and arrangement, the time is indicated on the dial of the clock by a triangle whose shape changes with time, in which the two sides 19, 20 correspond to the conventional hands of the clock and the third side 14*a* joins the outer ends of the sides 19, 20.

In a further embodiment of the invention, the reference lines 19, 20 are not provided so that only the line 14*a* is visible on the dial, the ends of this line facing the two separate zones of the periphery of the dial corresponding to the time to be indicated. In this case, reference indications may be provided on the central disc 10 and on the outer annular ring 13 to distinguish the end of the line 14*a* indicating the hours from the end indicating the minutes. For example, it is possible to adopt a solution of the type illustrated in FIG. 4. In this solution, an arrow is formed on the outer annular ring 13 adjacent the aperture 16, while a circular sign is carried by the central disc 10 adjacent the element 15. FIG. 5 illustrates a variant in which both ends of the line 14*a* are adjacent the outer edge of the dial. This may be achieved by the use of a central disc 10 having a larger diameter and an outer annular ring 13 which is relatively narrow radially.

Naturally, the embodiments described above are illustrated solely by way of example in the present application. Clearly, the display of the triangle of FIG. 3 or the display of the lines 14*a* of FIGS. 4 and 5 could be achieved, for example, by means of a liquid crystal system. FIG. 6 illustrates, by way of example, a solution which provides for the display of a line 14*a* (which in the example shown is a straight line) by means of a liquid crystal system, the ends of this line touching the outer edge of the dial so as to divide the inner surface of the dial into two areas 30, 31. Alternatively, the line 14*a* could be curved line. In the embodiment illustrated, the area 30 is further distinguished from the area 31 by the display of a series of parallel lines 32. Alternatively, one of the two areas 30, 31 could be rendered luminous in contrast to the other.

With regard to the solution illustrated in FIGS. 1 to 3, both in the case including the reference lines 19, 20 and in the case in which these lines are not provided, the use of a resilient wire or at least of resilient means associated with the wire 14 instead of the spool 17 may be envisaged.

A further alternative solution provides for the use of a relatively rigid elongate element, such as for example a metal wire which is fixed at one end to one of the two movable time indicator elements while passing through an aperture formed in the other element so as to have a first part projecting above the dial and a second part hidden beneath the dial. During movement of the movable elements, the elongate element slides in the aperture so as to leave a portion of this element above the dial located along a line joining the aperture to the zone of fixing of the elongate element.

It is also clear that the invention lends itself for application to any type of timepiece, whether it is a wristwatch, a table-clock, or a wall-clock.

In the case of the embodiment of FIG. 6, in order to distinguish from each other the two ends of the line 14*a* which indicate the hours and the minutes respectively, provision is made for the display of a reference sign 33 which moves along the outer annular ring of the dial adjacent one of the two ends of the line 14*a*.

FIGS. 7 and 8 illustrate a further embodiment relating to the case in which a triangle is displayed on the dial. With reference to these drawings, a clock 100 includes a casing 200 having a base wall 300 and housing a clock mechanism 400, from which project two concentric shafts 50, 60 for rotating the hands 70, 80 for indicating the hours and the minutes respectively. The hands move above a surface 90 of a fixed wall 101.

As clearly illustrated in the drawings, the outer ends of the hands 70, 80 are articulated by pins 110, 120 to the ends of a rod 130 constituted by two telescopically assembled elements 140, 150. The front face of the casing has an aperture 160 within which is a disc of glass or transparent plastics material 170. The rod 130 and the hands 70, 80 may have a cross-section other than circular. For example, these elements may have a flattened configuration. Any reference signs for the hours and the minutes can be on the surface 9.

Finally, it is possible to provide a solution which uses a telescopic rod 150 but does not have the two hands 70, 80. In this case, the two pins 110, 120 to which the ends of the telescopic rod are connected are carried respectively by a central disc and by an outer annular ring, similar to those provided in the solution of FIGS. 1 to 3.

Naturally, the principle of the invention remaining the same, the constructional details may be varied widely with respect to those described and illustrated purely by way of example.

I claim:

1. A clock comprising a clock casing, a dial, time indicator means associated with the dial, and means for controlling the indicator means, wherein the indicator means is comprised of a single straight line on the dial, the ends of the line pointing towards two separate zones of the periphery of the dial corresponding to the time to be indicated.

2. Clock according to claim 1, wherein the indicator means comprise a central disc, an annular outer ring concentric with the central disc, the central disc and the outer annular ring being rotated by the control means to indicate the hours and the minutes respectively, and said single straight line is comprised of a variable-length element which connects a zone of the annular outer ring to a zone of the central disc spaced from the center of the dial.

3. Clock according to claim 2, wherein the indicator means comprise a wire fixed at one end to the central disc in correspondence with the said zone and passing through an aperture defined in the outer annular ring in correspondence with the other zone, the clock further including a wire-winding spool which is biassed resiliently towards a fully-wound position and is arranged to maintain a portion of the wire between the two zones under tension, this portion of wire constituting the variable-length element.

4. Clock according to claim 1, wherein both ends of the line are adjacent the periphery of the dial.

5. Clock according to claim 1, wherein at least one of the ends of the time indicator line is spaced from the periphery of the dial.

6. Clock according to claim 1, wherein reference indications are associated with the ends of the time indicator line for distinguishing the end indicating the hours from the end indicating the minutes.

7. A clock comprising a clock casing, a dial, time indicator means associated with the dial and means for controlling the indicator means wherein said indicator means are comprises of a line on the dial having ends pointing towards two separate zones of the periphery of the dial corresponding to the time to be indicated and two further lines joining the center of the dial to the ends of said line.

8. A clock according to claim 7, wherein the indicator means is comprised of a central disc, an outer annular ring concentric with the central disc, said central disc and said outer annular ring being rotated by the control means to indicate the hours and the minutes respectively and a variable length element connecting a zone of the annular outer ring to a zone of the central disc spaced from the center of the dial.

9. A clock according to claim 8, wherein the central disc and the outer annular ring carry two reference elements extending radially between the center of the dial and said zones, respectively.

10. A clock according to claim 8, wherein the variable length element is constituted by a telescopic rod, the ends of which are articulated to the central disc and the outer annular ring, respectively.

11. A clock according to claim 7, wherein the time indicator means comprise a pair of hands which are rotated about the center of the dial to indicate the hours and the minutes, respectively, and a rod connecting the outer ends of the two hands and constituted by at least two elements slidable relatively to each other.

12. A clock according to claim 11, wherein the two elements of the connecting rod are fitted together telescopically.

* * * * *